United States Patent [19]

Fujiwara

[11] 4,343,558

[45] Aug. 10, 1982

[54] MECHANICAL PENCIL

[75] Inventor: Masashichi Fujiwara, Tokyo, Japan

[73] Assignee: Yugen Kaisha Tokyo Kinzoku Seisakusho, Tokyo, Japan

[21] Appl. No.: 110,463

[22] Filed: Jan. 8, 1980

[30] Foreign Application Priority Data

Jul. 31, 1979 [JP] Japan ..... 54-105740[U]
Aug. 16, 1979 [JP] Japan ..... 54-113252[U]

[51] Int. Cl.[3] ..... B43K 21/16
[52] U.S. Cl. ..... 401/67
[58] Field of Search ..... 401/62, 65, 67, 80, 401/92, 93, 94

[56] References Cited

U.S. PATENT DOCUMENTS

| | | | |
|---|---|---|---|
| 233,814 | 10/1880 | Sneider | 401/94 |
| 240,399 | 4/1881 | Frederick | 401/94 |
| 2,184,911 | 12/1939 | Fend | 401/65 |
| 2,517,297 | 8/1950 | Ferber | 401/67 |
| 2,528,328 | 10/1950 | Baker et al. | 401/67 |
| 2,800,109 | 7/1957 | Germann | 401/67 X |
| 2,844,125 | 7/1958 | Wehn | 401/93 |
| 4,149,813 | 4/1979 | Katz et al. | 401/65 |
| 4,162,080 | 4/1979 | Buck | 401/92 X |
| 4,171,170 | 10/1979 | Kageyama et al. | 401/65 |
| 4,180,339 | 12/1979 | Katz | 401/65 X |

FOREIGN PATENT DOCUMENTS

| | | |
|---|---|---|
| 46-17449 | 6/1971 | Japan . |
| 46-17450 | 6/1971 | Japan . |
| 46-17451 | 6/1971 | Japan . |
| 46-17452 | 6/1971 | Japan . |
| 52-6349 | 2/1977 | Japan . |

*Primary Examiner*—Edward M. Coven
*Attorney, Agent, or Firm*—Oblon, Fisher, Spivak, McClelland & Maier

[57] ABSTRACT

A mechanical pencil including a buffer spring is disclosed. The mechanical pencil has a chuck whose chucking point is elongated in the direction towards the front of the pencil so that if the lead is broken at the chucking point, the length of broken lead within the pencil is minimized, thereby reducing the amount of wasted lead. The buffer spring is located either adjacent the fastening ring or within the lead case. In either embodiment, the buffer spring buffers the impact of the chucking point against the fastening ring. In the embodiment where the buffer spring is located within the lead case, the lead case and an intermediate connecting member, together with the distance therebetween, form a buffer spring operating mechanism.

1 Claim, 23 Drawing Figures

MECHANICAL PENCIL

BACKGROUND OF THE INVENTION

1. Field of the Invention

The present invention relates to improvements of a mechanical pencil of the type having a push-out mechanism or the type provided with a lead chuck.

A feature of the invention is the possibility of saving lead by minimizing the length of the broken piece remaining in the holding tube in case of lead breakage.

Another feature of the invention is a composition of a mechanical pencil whereby leads are safely retracted so as not to be broken. That is, excessive pushing force applied to the lead case is buffered by a buffer spring so as not to be transmitted to the leads and the chuck, thus retracting the lead by the chuck without breaking the lead by the chuck within the holder tube or the thin tube at the end of the holder tube.

2. Description of the Prior Art

A chuck 2 used in the conventional push-out type mechanical pencils and mechanical pencils having a chuck as shown in FIGS. 14 to 23 has a two-slitted or three-slitted chuck point 201, the length of which is normally approximately 2 mm. Therefore, if a lead is broken at the end of the chuck point 201 due to some cause, the broken piece remaining between the end of the chuck point 201 and the end of the holder tube 1 or the tip end of the thin tube 10 becomes unnecessarily long, thus causing the waste of the lead a.

A variety of mechanical pencils having a chuck, as shown in FIGS. 14 to 23, have been introduced. These conventional mechanical pencils are supposed to be free from lead breakage trouble in the retraction of the lead a within the holder tube 1, especially in the first example of FIGS. 14 and 15. However, even the mechanical pencil of this type is not satisfactory. In this first example, the lower part of a chucking point 201 of a chuck 2 is formed in the shape of a large tapered closing cone. Therefore, the chucking point 201 is closed suddenly to instantaneously fasten the lead a when the chucking point 201 starts engaging with a movable ring 7 (immediately before the state shown in FIG. 15), even though the mechanical pencil is provided with a buffer spring 6 and the bore of the movable ring 7 is tapered corresponding to the taper of the lower part of the chucking point 201. This sudden fastening causes the lead a to be broken at the tip end of the chucking point 201.

Finally the buffer spring 6 is compressed as shown in FIG. 15. The mechanical pencil is then used for writing in the state as shown in FIG. 15. However, the chucking point 201 is not held steadfastly as the mechanical pencil of this type has no fastening ring so that the alignment of the chucking point 201 with the holder tube 1 is liable to be distorted causing the lead a to be broken.

Referring to FIGS. 16 and 17, these Figures show a second example of a pencil not being constructed to buffer the fastening force applied to the lead a when the chucking point 201 of the chuck 2 engages with a movable ring 7. Here, the lead a is liable to be broken at the tip of the chucking point 201 so that the chuck point 201 retracts only a part of the lead within the holder tube 1. Thus, the second example cannot eliminate lead breakage.

Referring to FIGS. 18 and 19, a third example is shown which has a smaller movable ring 7 inserted in a larger intermediate movable ring 701 and a buffer spring 6 between an end of the intermediate movable ring 701 and the holder tube 1 and where the external shape of a chucking point 201 of a chuck 2 is formed in a small reverse tapered cone. In this example, when a chucking point 201 of a chuck 2 is pulled up by the strong force applied by a retraction spring 3 and starts engaging with movable ring 7 (immediately before the state as shown in FIG. 18), the chucking point 201 strikes against the internal edge of the movable ring 7 so that the chucking point 201 is suddenly closed to thereby break the lead a as described in the first example referring to FIGS. 14 and 15. Furthermore, the third example has another disadvantage in that the chucking point 201 carrying the lead a and engaging with the movable ring 7 causes the movable ring 7 to strike against a shoulder 103 when being pulled into retraction by the retraction spring 3 as shown in FIG. 18 and the shock caused to the chucking point 201 by the striking of the movable ring against the shoulder 103 often breaks the lead a.

Referring to FIGS. 20 and 21, a fourth example is shown. In this fourth example, a chucking point 201 carrying the lead a and engaging with a movable ring 7 also strikes the movable ring against a shoulder 103 to stop pulling movement by retraction spring 3 (movement from the state as shown in FIG. 21 to the state as shown in FIG. 20), and the shock caused by the striking of the movable ring against the shoulder 103 often breaks the lead a.

Referring to FIGS. 22 and 23, a fifth example is shown which also has a disadvantage similar to that of the fourth example. The fifth example has two movable rings 7 and 701. The upper movable ring 7 has a downwardly opening conical internal surface while the lower movable ring 701 has an upwardly opening conical internal surface. Although the upper surface of the chucking point 201 of the chuck 2 is shaped to fit exactly in the conical bore of the upper movable ring 7, the lead a is liable to be broken because the chucking point 201 of the chuck 2 is pulled upward by a strong retraction spring 3 from the position shown in FIG. 23 and first engages with the upper movable ring 7, then is pulled further together with the movable ring 7 until the upper movable ring 7 strikes severely against a shoulder 103. The lead a is often broken at the end of the chucking point 201 of the chuck 2 by the severe impact.

Various mechanisms for retracting the lead within the holder tube have been introduced as hereinbefore described in reference to FIGS. 14 to 23, however, none of these conventional mechanisms is effective in overcoming the disadvantage that the lead is often broken by the impulsive chucking applied by the chucking point when the chuck retracts. This disadvantage is conspicuous when thick but soft leads or hard but thin (0.5 mm to 0.2 mm in diameter) leads are used. This disadvantage is caused by the lack of a buffer mechanism which moderates the impact applied to the lead by the fastening action of the chucking point.

SUMMARY OF THE INVENTION

Accordingly, an object of the present invention is to provide a mechanical pencil in which the chucking point of the chuck is lengthened in the axial direction so that the tip of the chucking point approaches the end of the holder tube or the tip of the thin tube, thus shortening the length of the brokent lead if the lead is broken at the tip of the chucking point due to some cause.

Another object of the present invention is to provide a mechanical pencil which is capable of safely retracting the load within the holder tube or a thin tube secured at the end of the holder tube.

BRIEF DESCRIPTION OF THE DRAWINGS

Various other objects, features and attendant advantages of the present invention will be more fully appreciated as the same becomes better understood from the following detailed description when considered in connection with the accompanying drawings wherein like reference characters designate like or corresponding parts throughout the several views, and wherein:

FIGS. 14 to 23 are sectional views of the principal part of the conventional mechanical pencils, in which, FIG. 14 shows a first example with the lead retracted, FIG. 15 shows the first example with the lead projected for use, FIG. 16 shows a second example with the lead retracted;

FIG. 17 shows the second example during the retraction of the lead,

FIG. 18 is a third example with the lead retracted,

FIG. 19 is a sectional view of the third example immediately before the retraction of the lead, FIG. 20 is a fourth example with the lead retracted, FIG. 21 is a sectional view of the principal part of the fourth example immediately before the retraction of the lead, FIG. 22 is a sectional view of a fifth example with the lead retracted, and FIG. 23 is a sectional view of the principal part of the fifth example immediately before the retraction of the lead.

DETAILED DESCRIPTION OF THE PREFERRED EMBODIMENTS

A first embodiment of the invention will be described referring to FIGS. 1 to 7.

Figure 1:
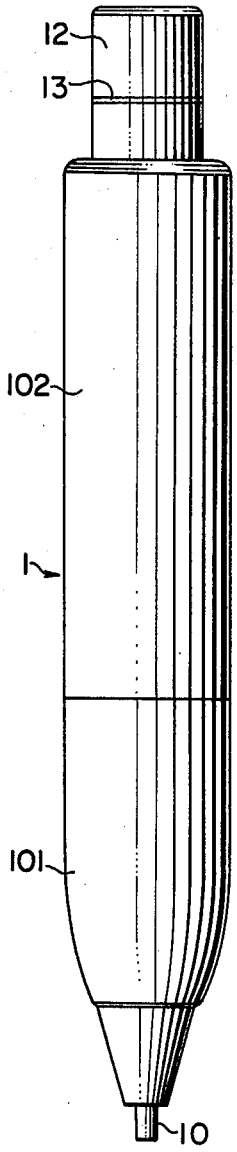
FIG. 1 is an external view of a mechanical pencil according to the present invention with the lead retracted.
Figure 2:
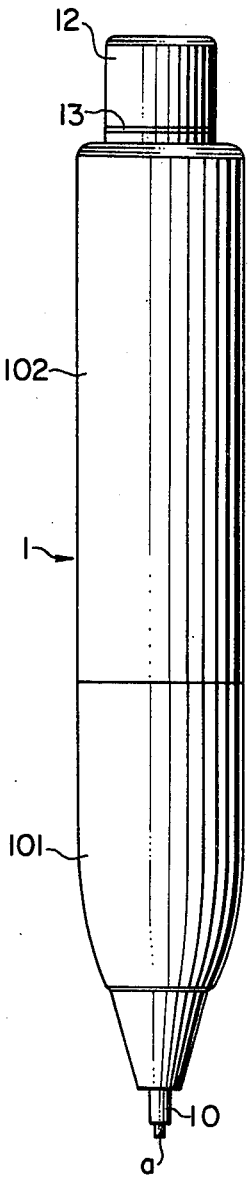
FIG. 2 is an external view of a mechanical pencil according to the present invention with the knocker cap pushed-in as far as a mark reaching the rear end of a rear holder tube to project the lead from a thin tube and the mechanical pencil is ready for use.
Figure 3:
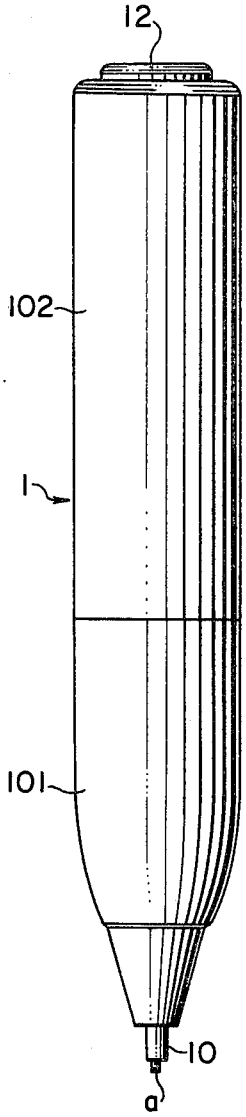
FIG. 3 is an external view of a mechanical pencil according to the present invention with a knocker cap fully pushed-in and the lead prepared for being retracted.
Figure 4:
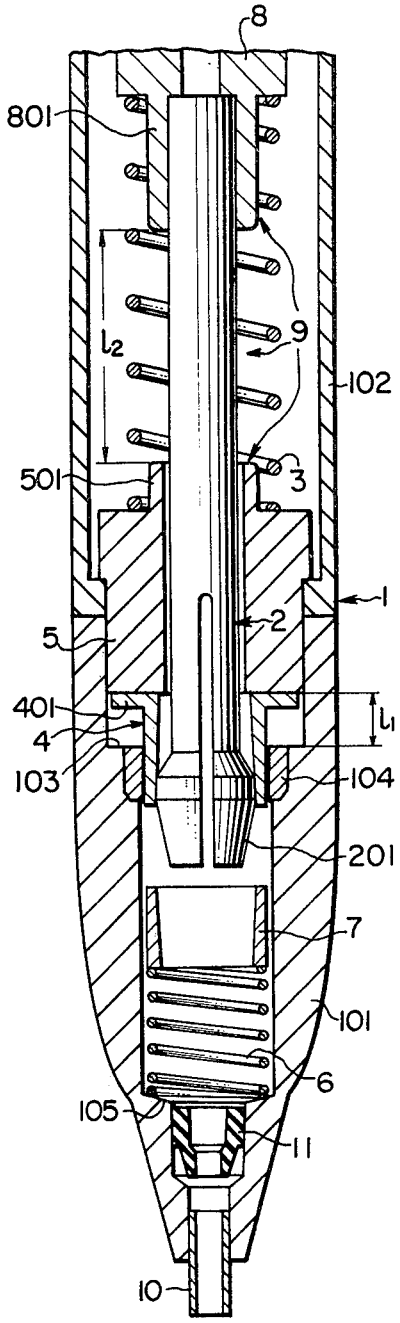
FIG. 4 is a partial enlarged sectional view of FIG. 1.
Figure 5:
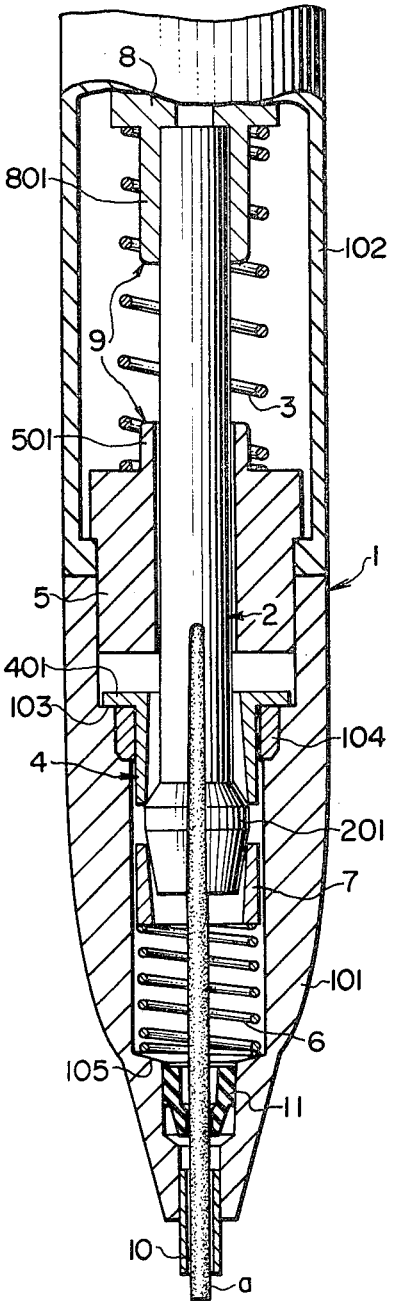
FIG. 5 is a partial enlarged sectional view of FIG. 2.
Figure 6:
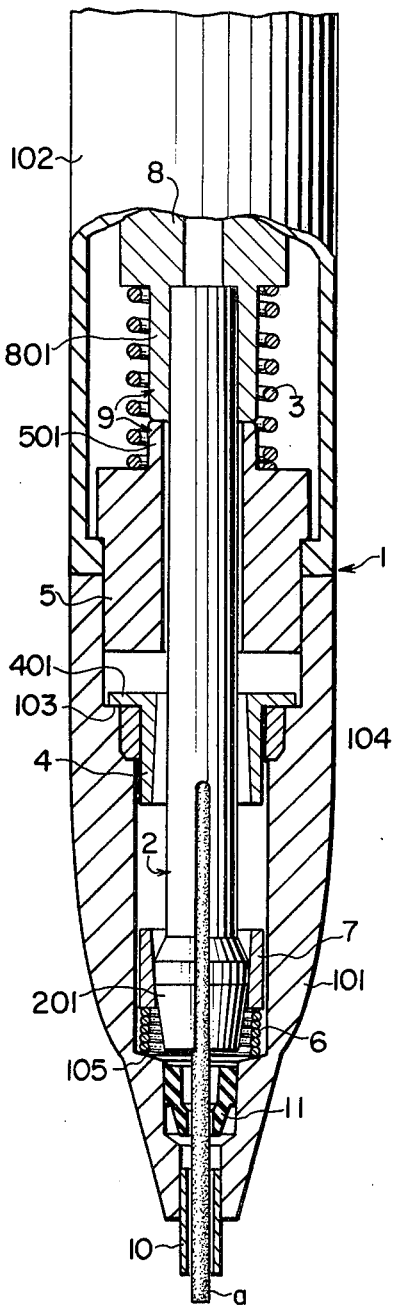
FIG. 6 is a partial enlarged sectional view of FIG. 3.
Figure 7:
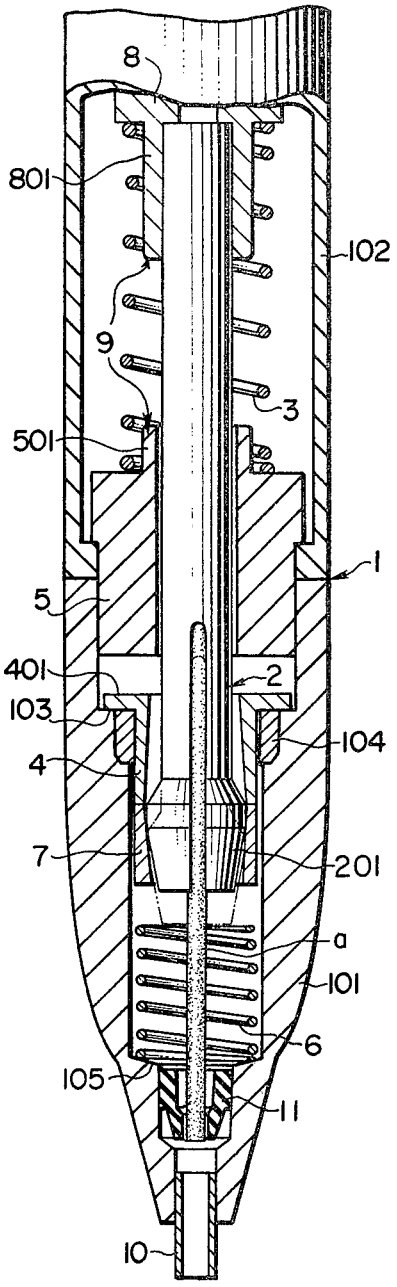
FIG. 7 is a partial enlarged sectional view of a mechanical pencil according to the present invention wherein the mechanical pencil is being operated from the state as shown in FIG. 3 to the state as shown in FIG. 1, that is from FIG. 6 to FIG. 4, with a chuck retracting the lead while the chuck is almost leaving a movable ring and engaging with a fastening ring.

A holder tube 1 consists of a front tube 101 and a rear tube 102 separably connected by an intermediate connecting piece 5. A buffer spring 6 and a movable ring 7 are inserted in the front tube 101. A chucking point 201 of a chuck 2 is split in two or three fingers. The front half of the chucking point 201 is elongated in the axial direction longer than that of the conventional ones to make the total length of the chucking point 201 about 3.5 mm longer than the conventional chucking points so that the chucking point 201 of this invention is adapted to approach closer to the front end of the front tube 101 to mimimize the distance between the front end of the chucking point 201 and the front end of the front tube 101 (FIG. 4). The rear end of the chuck 2 is connected to a lead case 8. A retraction spring 3 is positioned between the intermediate connecting piece 5 and the lead case 8 and is normally urging the chuck 2 connected to the lead case 8 rearward. The internal surface, or a part of the internal surface, of a fastening ring 4 is shaped in a frontwardly opening conical surface. A flange 401 of the fastening ring 4 is located between a shoulder 103 formed near the rear end of the front tube 101 and the front end of the intermediate connecting piece 5. A setting ring 104 is fitted in the front tube 101 in a manner such that the rear end of the setting ring 104 is aligned with the shoulder 103. The fastening ring 4 slides smoothly between the intermediate connecting piece 5 and the shoulder 103. The chuck 2 is smoothly slidable through the bore of the fastening ring 4. The inner diameter of the setting ring 104 is a little smaller than the diameter of the bore of the front tube 101 in which the buffer spring 6 and the movable ring 7 are inserted, so as to allow the fastening ring 4 to smoothly move through the setting ring 104. A protrusion 501 of the intermediate connecting piece 5 is formed to receive one end of the retraction spring 3. The chuck 2 moves through the bore of the intermediate connecting piece 5. The distance $l_2$ between the protrusion 501 and a protrusion 801 of the lead case 8 defines the stroke of the chuck 2. The chuck 2 advances to the extent that the protrusion 801 comes in contact with the protrusion 501. The buffer spring 6 is compressed as the movable ring 7 advances. At the final position of the movable ring 7, the buffer spring 6 is not completely compressed and a distance remains between the front end of the movable ring 7 and a shoulder 105. The buffer spring 6 urges the movable ring 7 in the direction of retraction of the lead a. The internal surface or a part of the internal surface of the movable ring 7 is tapered. The movable ring 7 is fitted in the front tube 1 so as to compress the buffer spring 6. A knocking cap 12 having a lead push-out mark 13 is removably positioned on one end of the lead case 8 as shown in FIG. 1. The lead is pushed out from a thin tube 10 when the knocking cap 12 is pushed in until the mark 13 reaches the rear end of the rear tube 102. FIGS. 1 and 2 correspond to FIGS. 4 and 5, respectively. When the knocking cap 12 is pushed in further as shown in FIG. 3, the chucking point 201 of the chuck 2 advances and chucks the lead a to make ready for retracting the lead a as shown in FIGS. 3 and 6. When the knocking cap 12 is released at the position shown in FIGS. 3 and 6, the knocking cap 12 returns to the position shown in FIG. 1 and the lead a is retracted by the chucking point 201 of the chuck 2 within the front tube 101 as shown in FIG. 7.

The manner of operation will be described referring to FIG. 4. As the knocking cap 12 is pushed in until the mark 13 reaches the rear end of the rear tube 102 and the chuck 2 advances, the chuck 2 and the fastening ring 4 advance together starting from the position shown in FIG. 4. The fastening ring 4 stops when the flange 401 abutts the setting ring 104 and the shoulder 103. The chuck 2 advances further, separating from the fastening ring 4 to release the lead a after the lead a has been pushed out from the thin tube 10 as shown in FIG. 5. When the knocking cap 12 is released and pushing force is removed from the chuck 2 at the position shown in FIG. 5, first the retraction spring 3 pulls back the chuck 2 and the chucking point 201 of the chuck 2 engages with the fastening ring 4 again, then the chucking point 201 and the fastening ring 4 are retracted together until the flange 401 hits on the front end of the intermediate connecting piece 5 so that the chucking point 201 of the chuck 2 is closed by sliding along the tapered internal surface of the fastening ring 4 to fasten the lead a thus making ready for writing.

As the chuck 2 is pushed further from the state as shown in FIG. 5, the chucking point 201 of the chuck 2 lightly engages with the movable ring 7 so that the movable ring 7 also advances gradually compressing the buffer spring 6 until the chuck 2 has travelled the full stroke. When the chuck 2 stops, the compression force of the buffer spring 6 pushes back the movable ring 7 so that the movable ring 7 and the chucking point 201 are engaged more closely to fastly chuck the lead a as shown in FIG. 6. In this state, the position of the knocking cap 12 is shown in FIG. 3. When the knocking cap is released at the position of FIG. 6, the compressed retraction spring 3 pulls back the chucking point 201, which is chucking the lead a and engaged with the movable ring 7. The chuck and the movable ring 7 are retracted together; then the movable ring 7 separates from the buffer spring 6 and hits on the front end of the fastening ring 4 (FIG. 7). The chucking point 201, the movable ring 7 and the fastening ring 4 are then retracted together. When the flange strikes the front end of the intermediate connecting piece 5, the chucking point 201 separates from the movable ring 7. Then the chucking point 201 is pulled in the conical internal surface of the fastening ring 4 and the movable ring 7 falls back down to the buffer spring 6, thus retracting the lead a as shown in FIG. 7. In this state, the position of the knocking cap 2 is shown in FIG. 1. Although the chucking point 201 opens when the chucking point 201 moves from the movable ring 7 to the fastening ring 4, the lead a will not freely fall off since a rubber ring 11 fitted in the front tube 1 at its front end constrains free movement of the lead a and keeps the lead a retracted. After a moment, the chucking point 201 engages with the fastening ring 4 so that the chucking point 201 is gradually closed to chuck the lead a again to securely hold the lead a at the retracted position.

It is obvious from what has been described hereinbefore that the mechanical pencil of this invention is capable of saving leads as the chucking point 201 of the chuck 2 is elongated in the axial direction to make the front end of the chucking point 201 approach closer to the front end of the front holder tube 101, thus reducing the length of the broken lead remaining in the front holder tube 101 in the case where lead breakage occurs. Furthermore, in retracting the lead a within the holder tube 1, the chucking force applied to the lead is moderated by the buffer spring 6 in combination with a combination of elements consisting of the fastening ring 4 having conical internal surface, the movable ring 7 also having conical internal surface and the chuck stroke defining structure 9 to minimize the possibility of lead breakage. Still further, the chucking force moderating effect of the buffer spring 6 makes the chucking force uniform if the chuck 2 is pushed gently or violently so that the possibility of lead breakage is reduced.

Thus the first embodiment according to the present invention is provided with an axially elongated chucking point to make the front end of the chucking point approach closer to the front end of the holder tube to reduce the distance between the front end of the chucking point and the front end of the holder tube at the position immediately before the retraction starts. Accordingly, if lead breakage occurs at the front end of the chucking point, where lead breakage is most possible, the length of the broken, waste lead is minimized to reduce useless consumption of leads.

Referring to FIGS. 8 to 13, a second embodiment according to the present invention has the buffer spring 6 within the rear holder tube 102 while the first embodiment has the buffer spring 6 in the front holder tube 101. The combination within the holder tube is changed from that of the first embodiment according to the disposition of the buffer spring 6. A front holder tube 101 and a rear holder tube 102 are separably connected by an intermediate connecting piece 5. A movable ring 7 is slidably inserted within the front holder tube 101 and a rubber ring 11 is fitted near the point of the front holder tube 101 in front of the movable ring 7. A thin tube 10 is fixed at the front end of the front holder tube 101. A chuck 2 consists of a chucking point 201 having two or three split fingers for chucking the lead a and a tubular part 202 connected with a lead case 8. Near the rear end of the tubular part 202 is formed a flange 203 which is closely but movably engaged within the lead case 8. The front surface of the chucking point 201 is formed in a small tapered cone so as to gradually engage the chucking point 201 within the movable ring 7. The retraction spring 3 is disposed between the front end of the lead case 8 and the rear end of the intermediate connecting piece 5, always urging the chucking point 201, which is connected with the lead case 8, in the direction of retraction. The internal surface or a part of the internal surface of a fastening ring 4 is formed in a cone to gradually fasten the chucking point 201 of the chuck 2. A flange 401 is formed at the rear end of the fastening ring 4 and is disposed between a setting ring 104, the rear end of which is aligned with the shoulder 103 formed within the front holder tube 101, and the front end of the intermediate connecting piece 5. The flange 401 is smoothly slidable for a distance $l_2$ between the front end of the intermediate connecting piece 5 and the surface formed by the rear face of the shoulder 103 and the rear end face of the setting ring 104. The chuck 2 is inserted through the fastening ring 4 and the chucking point 201 is engaged and disengaged with the internal surface of the fastening ring 4.

The inside diameter of the setting ring 104 is smaller than the inside diameter of the front part of the front holder tube 101, in which the movable ring 7 is inserted, and is defined to allow smooth movement of the fastening ring 4. The buffer spring 6 is disposed between the flange 203 of the chuck 2 and a bush 802 fixed near the front end of the lead case 8 and always urges the chuck 2 frontward (the direction to push out the lead a). The rear part of the tubular part 202 of the chuck 2 having the flange 203 is closely but slidably inserted within the lead case 8. The flange 203 rests on the front shoulder of the lead case 8. The buffer spring 6 is compressed between the flange 203 and the bush 802. The front part of the tubular part 202 having the chucking point 201 is connected with the rear part of the tubular part 202, thus combining the lead case 8 and the chuck 2. When the lead case 8 is pushed forward, the chucking point 201 of the chuck 2 separates from the fastening ring 4 and lightly engages with the movable ring 7.

A protrusion 801 formed at the front end of the lead case 8 receives one end of the retraction spring 3. The protrusions 801 and 501 of the lead case 8 and the intermediate connecting piece 5, respectively, and the distance l between the protrusions, define the buffer spring operating mechanism 9. When the lead case 8 is pushed until the protrusion 801 comes in contact with the protrusion 501 reducing the distance l to zero, the buffer spring 6 starts functioning to cause the chucking point 201 of the chuck 2 to gradually engage with the movable ring 7.

The protrusion 501 is formed on one end of the intermediate connecting piece 5 facing opposite the lead case 8. The chuck 2 is inserted through the bore of the intermediate connecting piece 5. The front holder tube 101 and the rear holder tube 201 are joined by the intermediate connecting piece 5 to form the holder tube 1. The protrusion 501, the protrusion 801 of the lead case 8 and the distance l between the protrusions define an operating mechanism 9.

The internal surface or a part of the internal surface of the movable ring 7 is formed in a tapered cone. The movable ring 7 is inserted within the holder tube 1 near the front end and engages with and gradually closes the chucking point 201 when the chuck 2 advances while separating from and allowing the chucking point 201 gradually to open when the chuck 2 retracts.

Figure 8:
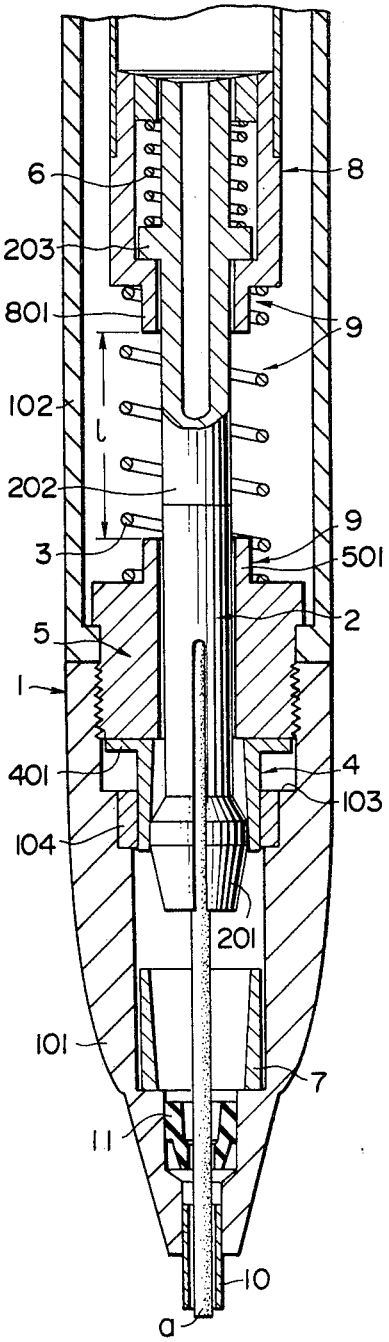
FIG. 8 is a sectional view of the principal part of another embodiment according to the present invention with the knocker cap pushed in to the final position as shown in FIG. 2 to push out the lead from the thin tube to make the mechanical pencil ready for use.
Figure 9:
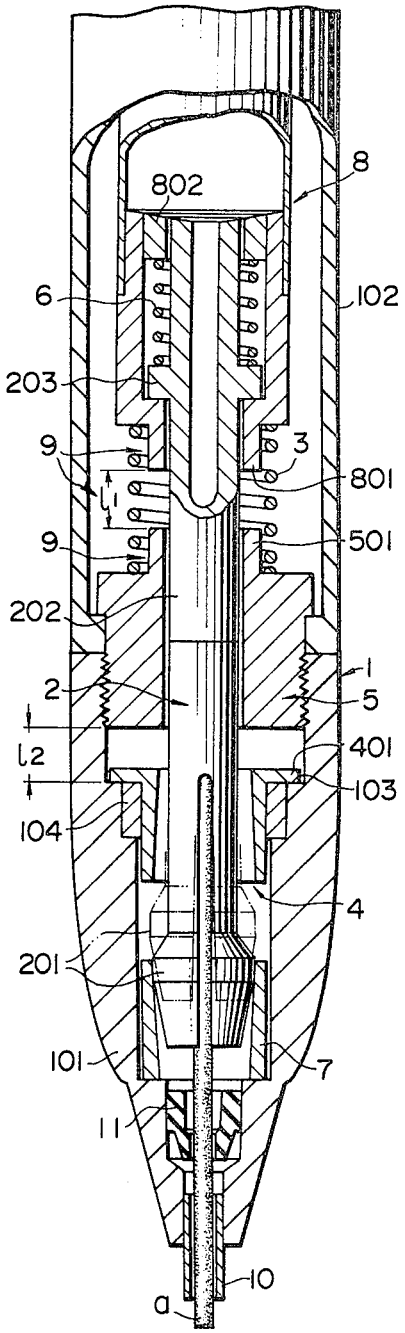
FIG. 9 is a sectional view of the principal part of the second embodiment according to the present invention showing the state where an operation to retract the lead has just been started by pushing the knocker cap toward the position as shown in FIG. 3.
Figure 10:
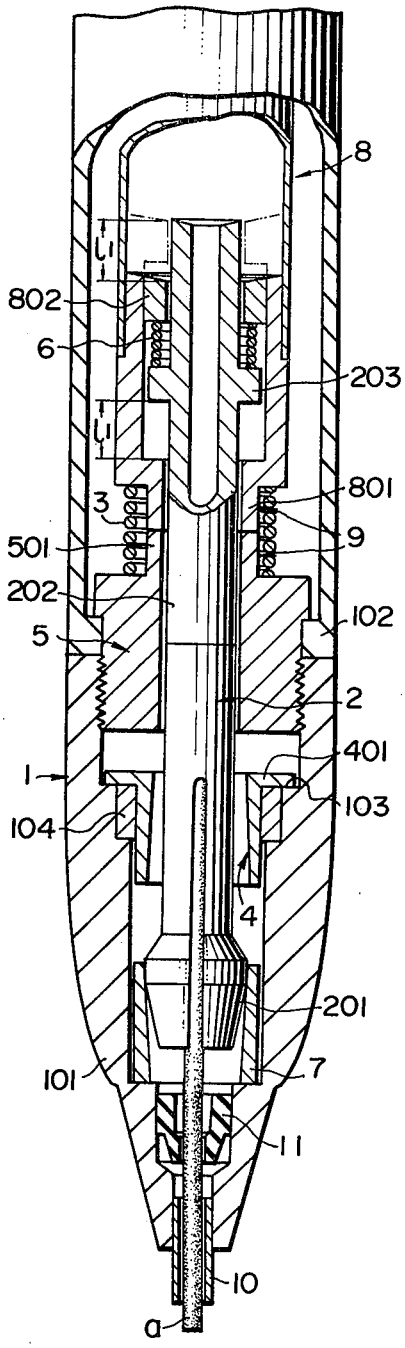
FIG. 10 is a sectional view of the principal part of the second embodiment according to the present invention with the knocker cap pushed in to the final position as shown in FIG. 3.
Figure 11:
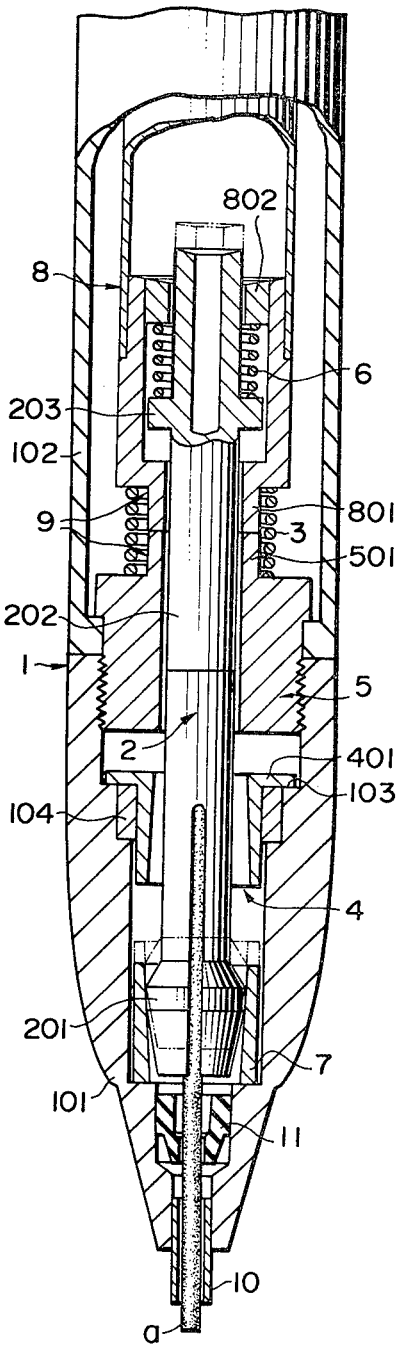
FIG. 11 is a sectional view of the principal part of the second embodiment according to the present invention with the knocker cap pushed in to the final position and the lead ready for being retracted
Figure 12:
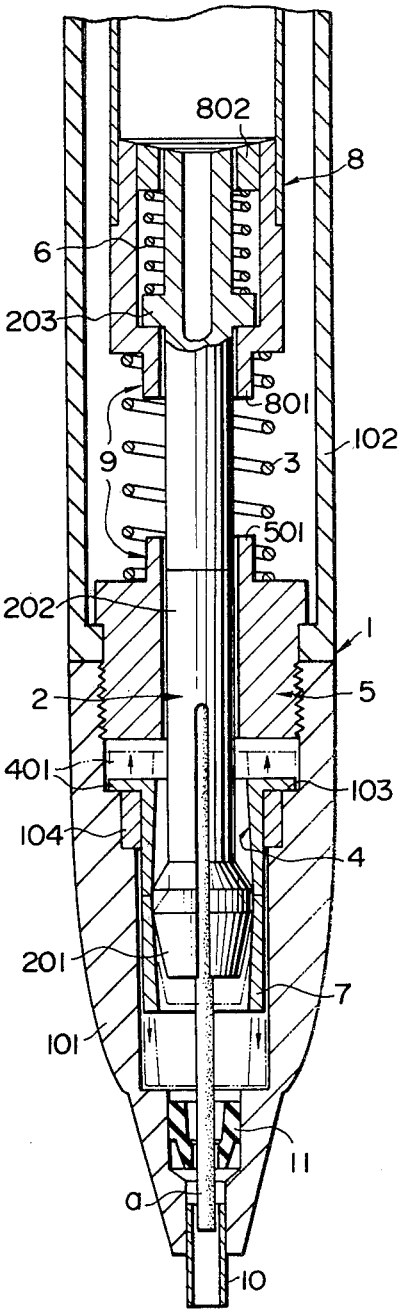
FIGS. 12 and 13 are sectional views of the principal part of the second embodiment according to the present invention with the knocker cap released after being pushed in to the final position to retract the lead and the knocker cap is on the way back to the position of FIG. 1 from the position of FIG. 3.
Figure 13:
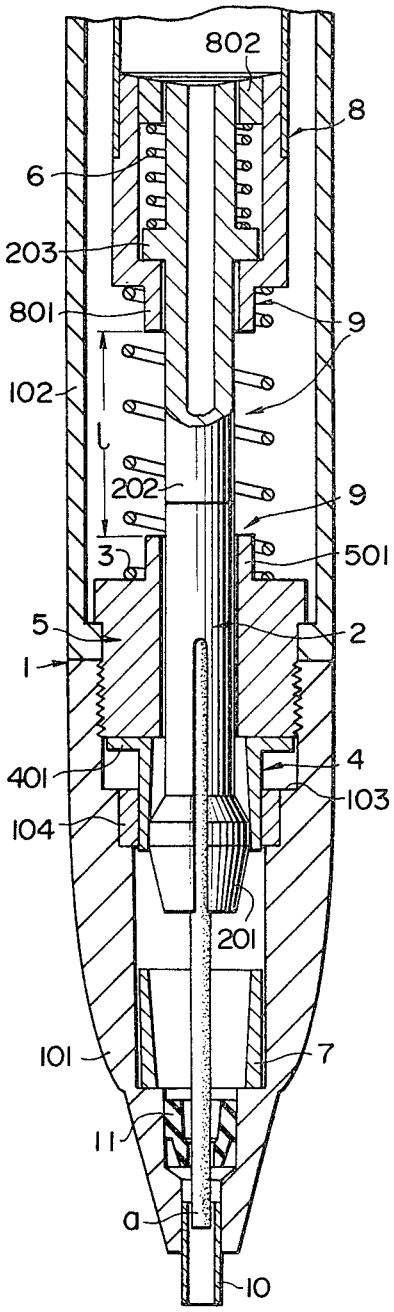
Figure 14:
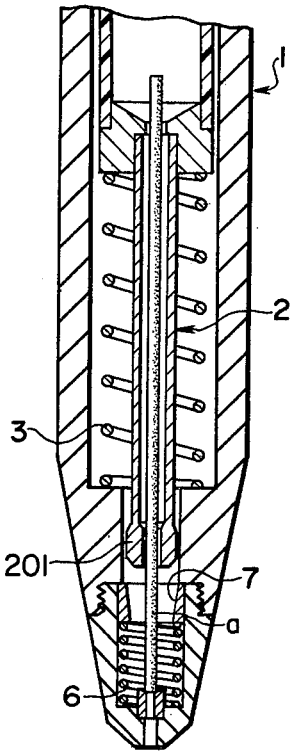
FIG. 14 PRIOR ART
Figure 15:
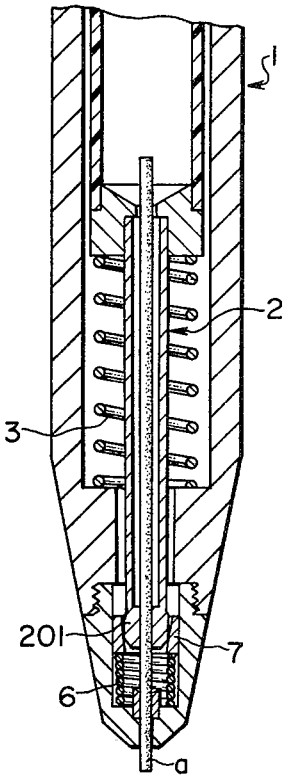
FIG. 15 PRIOR ART
Figure 16:
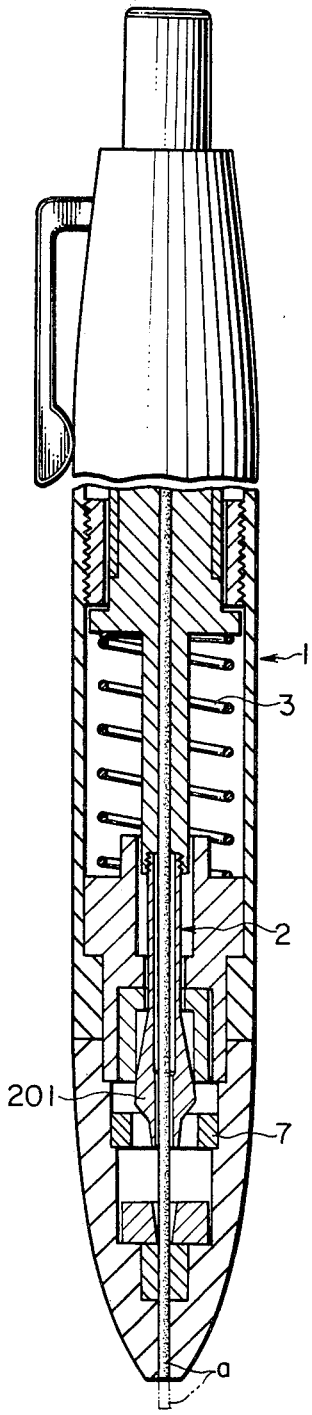
FIG. 16 PRIOR ART
Figure 17:
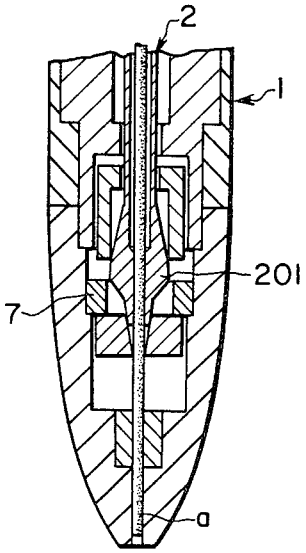
FIG. 17 PRIOR ART
Figure 18:
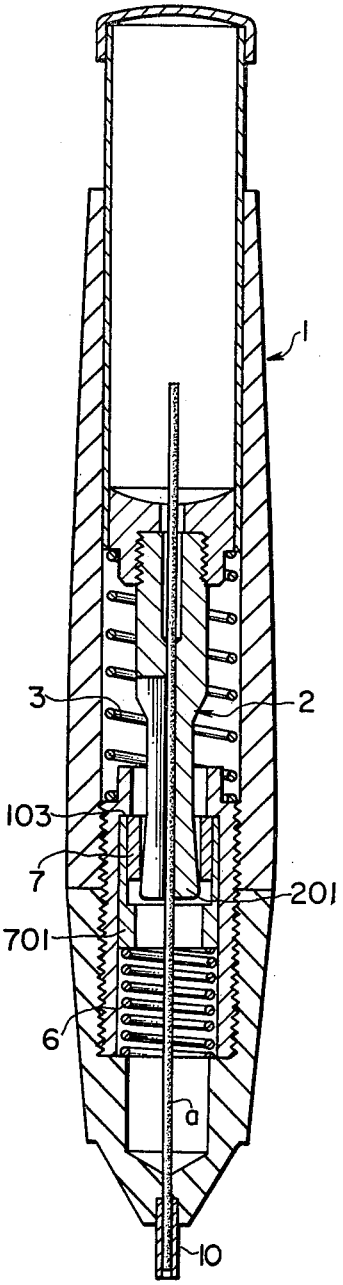
FIG. 18 PRIOR ART
Figure 19:
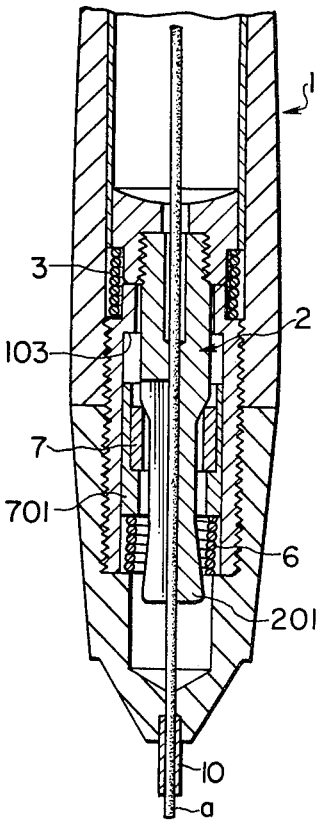
FIG. 19 PRIOR ART
Figure 20:
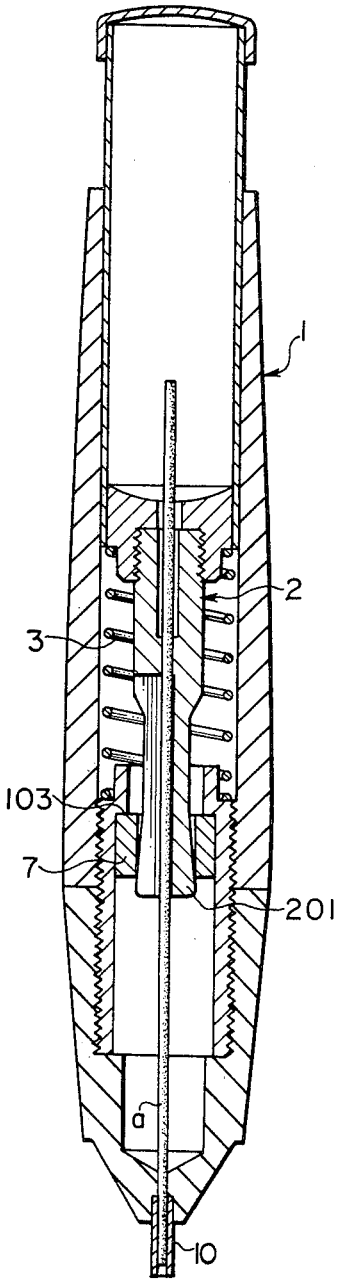
FIG. 20 PRIOR ART
Figure 21:
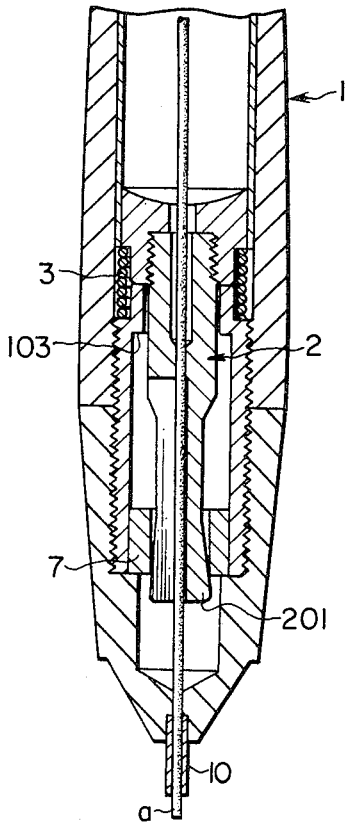
FIG. 21 PRIOR ART
Figure 22:
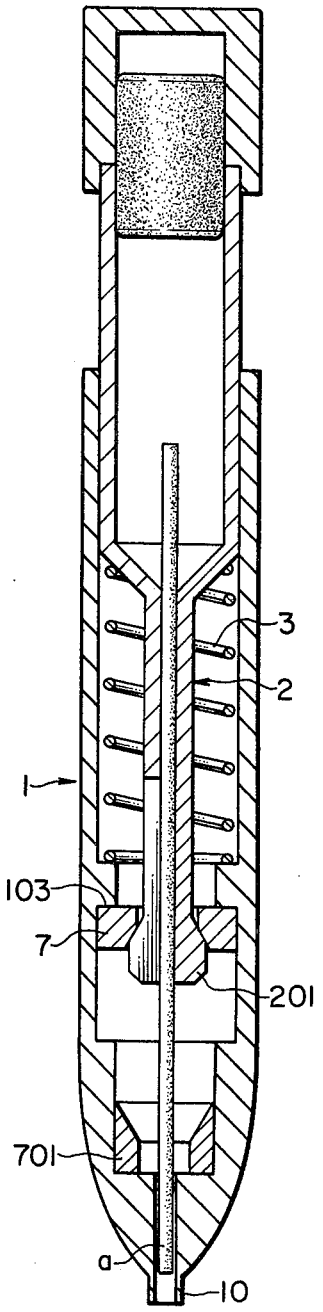
FIG. 22 PRIOR ART
Figure 23:
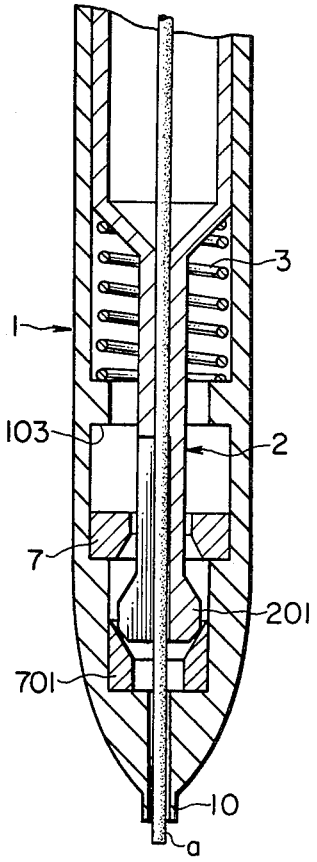
FIG. 23 PRIOR ART

Referring first to FIG. 8, the manner of retraction of the lead a will be described. In FIG. 8, the lead a is projecting from the thin tube 10 and the mechanical pencil is ready for writing. In this state, when the knocking cap 12 fitted on the rear end of the lead case 8 is pushed, the lead case 8 advances a little while pressing the retraction spring 3 a little. As a result, the distance l between the protrusions 501 and 801 is reduced to a distance $l_1$. Consequently, the flange 203 is pushed forward together with the lead case 8 without changing its position relative to the lead case 8 as the flange 203 is movably but closely fitted in the lead case 8 so that the chucking point 201 separates from the fastening ring 4 and lightly engages with the movable ring 7 as shown in FIG. 9. When the disposition of the mechanism changes from the state as shown in FIG. 8 to the state as shown in FIG. 9, the buffer spring 6 is not compressed but the retraction spring 3 is compressed as the tubular part 202 of the chuck 2 is closely but slidably fitted in the lead case 8. Therefore, the chuck 2 and the lead case 8 are pushed forward together and the chucking point 201 is separated from the fastening ring 4 and lightly engages with the movable ring 7. When the chucking point 201 is separated from the fastening ring 4, the chucking point 201 opens and releases the lead a for a moment allowing the lead a to project from the thin tube 10 a little longer than the length shown in FIG. 8. When the chucking point is lightly engaged with the movable ring 7, the chucking point 201 is closed to chuck the lead a lightly. As the lead case 8 is pushed further by the knocking cap 12, the protrusion 801 advances for the distance $l_1$ while compressing the retraction spring 3 and comes in contact with the protrusion 501 and stops. When the lead case 8 stops, the flange 203 separates from the internal front end of the lead case 8 compressing the buffer spring 6 for a distance $l_1$, while the rear end of the chuck 2 projects from the bush 802 for a distance $l_1$ as shown in FIG. 10. In FIG. 10, the chucking point 201 is lightly engaging with the movable ring 7 and lightly chucking the lead a as in the state of FIG. 9, then after a moment, the compressed buffer spring 6 gradually pushes the chucking point 201 to be fastly engaged with the movable ring 7 and to fastly chuck the lead a as shown in FIG. 11, which illustrates the mechanical pencil in the state immediately before the retraction of the lead a. In FIG. 9, when the lead case 8 is pushed by the knocking cap 12, the pushing force is buffered by the buffer spring 6 and the movement of the lead case 8 is limited to the distance $l_1$. The chuck 2 is gradually pushed forward by the buffer spring 6 after the lead case 8 has come to stop with the protrusions 801 and 501 in contact thereby avoiding instantaneous application of excessive chucking force to the lead a and thus preventing lead breakage. In the state as shown in FIGS. 10 and 11, the lead case cannot be advanced further as the protrusion 801 of the lead case 8 and the protrusion 501 of the intermediate connecting piece 5 are in contact. Therefore, any pushing force applied to the lead case 8 will not affect the chucking point 201 and the lead a. In FIG. 11, when the lead case 8 is released by removing the pushing force from the knocking cap 12, the compressed retraction spring 3 retracts the lead case 8. Simultaneously, the compressed buffer spring 6 expands in the direction to project the lead a, pushing the flange 203 of the tubular part 202 of the chuck 2 as far as the internal front end of the lead case 8. The chucking point 202 of the chuck 2 fastly engaging with the movable ring 7 and fastly chucking the lead a is retracted for the distance l corresponding to the distance of retraction of the lead case 8 by the retraction spring 3; thus the retraction of the lead a starts. FIG. 11 shows the disposition of the lead case 8, the engagement of the flange 203 relative to the lead case 8 and the condition of the retraction spring 3 and the buffer spring 6 at the moment the retraction of the lead a starts. During the course of retraction, the chucking point 201 and the movable ring 7 move together and are engaged with each other as shown by alternate long and two short dashed lines in FIG. 11. After the retraction has started, the lead case 8 and the chuck 2, the flange 203 of which is engaged with the lead case 8, are continuously retracted according to the expansion of the retraction spring 3. The movable ring 7 is retracted together with the chucking point 201 until the rear end of the movable ring 7 comes in contact with the front end of the fastening ring 4 resting with its flange 401 in contact with the shoulder 103 of the front holder tube 101 and the rear end of the setting ring 104 as shown in FIG. 12. Then, the fastening ring 4 also is retracted until the flange 401 comes in contact with the front end of the intermediate connecting piece 5 and is stopped, so that the chucking point 201 moves from the movable ring 7 to the fastening ring 4 and the movable ring 7 becomes free to return to the original position of FIG. 8. Thus the lead a which has been projecting from the thin tube 10 is safely retracted within the thin tube 10 without being broken, as shown in FIG. 13. The relative disposition of the component parts during the retraction of the lead a is illustrated by FIGS. 11, 12 and 13.

In the state shown in FIG. 12, the chucking point 201 may open a little and loosen the lead a corresponding to the shape of the internal surface of the movable ring and the fastening ring when the chucking point 201 moves from the movable ring 7 to the fastening ring 4. However, the rubber ring 11 fitted in the front holder tube 101 prevents the accidental projection of the lead a from the thin tube 10.

In order to push out the lead a from the position of FIG. 13 to the position of FIG. 8, the knocking cap 12 is pushed repeatedly in a short stroke with the mark 13 as a guide. Consequently, the chucking point 201 is oscillated between the position of FIG. 13 and the position where the chucking point 201 is lightly engaged with the movable ring 7 as the lead case 8 is pushed and retracted, thus repeating opening and closing of the chucking point 201 to gradually advance the lead a and finally projecting it from the thin tube 10 as shown in FIG. 8. Then the mechanical pencil is ready for use.

The second embodiment according to the present invention being thus composed, impactive chucking force will not be applied to the lead during the course of retraction. Further, the pushing force applied to the lead case being buffered by the buffer spring and moderately transmitted to the chucking point and the lead, the lead is safely retracted without being broken.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A mechanical pencil comprising:

a holder tube having a back end and a front end, and having an intermediate connecting piece located therein;

a hollow movable lead case having a back end and being positioned in the back end of said tube;

a lead chuck, said lead chuck having a back end movably fitted within said lead case and a front end in the front end of said tube, said back end of said lead chuck including a shoulder means;

a buffer spring having a first spring rate and being positioned between said shoulder means and the back end of said lead case to bias said shoulder means against the front end of said lead case;

a retraction spring having a spring rate less than said first spring rate and being located between said lead case and said intermediate connecting piece and compressible by movement of said lead case, said movement of said lead case moving said lead chuck towards said front end of said tube via the biasing of said buffer spring;

a movable fastening ring having a conical internal surface in the front end of said holder tube, said fastening ring being positioned so as to be engageable with said chuck for chucking said lead when said chuck is moved toward said front end of said tube; and a buffer spring operating mechanism comprised of said front end of said lead case, the rear end of said intermediate connecting piece and a predetermined distance therebetween, wherein said engagement between said chuck and said fastening ring occurs at said predetermined distance, whereby said buffer spring operating mechanism causes said buffer spring to compress upon compression of said retraction spring due to said engagement between said chuck and said fastening ring so that the impact of engagement of said front end of said lead chuck with said fastening ring is buffered.

* * * * *

UNITED STATES PATENT AND TRADEMARK OFFICE

CERTIFICATE OF CORRECTION

PATENT NO. : 4,343,558

DATED : August 10, 1982

INVENTOR(S) : MASASHICHI FUJIWARA

It is certified that error appears in the above—identified patent and that said Letters Patent is hereby corrected as shown below:

Column 2, line 67, correct the spelling of "broken".

Column 3, line 3, change "load" to --lead--.

Signed and Sealed this

*Seventeenth* Day of *May 1983*

[SEAL]

*Attest:*

DONALD J. QUIGG

*Attesting Officer*

*Acting Commissioner of Patents and Trademarks*